US007933168B2

(12) United States Patent
Kawaguchi

(10) Patent No.: US 7,933,168 B2
(45) Date of Patent: Apr. 26, 2011

(54) ELECTRONIC TIMEPIECE WITH GENERATOR FUNCTION

(75) Inventor: Takashi Kawaguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 498 days.

(21) Appl. No.: 12/046,340

(22) Filed: Mar. 11, 2008

(65) Prior Publication Data

US 2008/0225647 A1 Sep. 18, 2008

(30) Foreign Application Priority Data

Mar. 14, 2007 (JP) ..... 2007-065646

(51) Int. Cl.
*G04B 9/00* (2006.01)
*G04C 23/00* (2006.01)
*G04C 3/00* (2006.01)

(52) U.S. Cl. ..... 368/66; 368/204

(58) Field of Classification Search ..... 368/64, 368/66, 204; 310/40 R, 49.01
See application file for complete search history.

(56) References Cited

U.S. PATENT DOCUMENTS

| | | | | |
|---|---|---|---|---|
| 5,889,736 | A * | 3/1999 | Fujita et al. | 368/66 |
| 6,061,304 | A * | 5/2000 | Nagata et al. | 368/66 |
| 6,147,936 | A * | 11/2000 | Nakajima | 368/205 |
| 6,278,663 | B1 * | 8/2001 | Okeya et al. | 368/204 |
| 6,580,665 | B1 * | 6/2003 | Kamiyama et al. | 368/66 |
| 6,816,439 | B1 * | 11/2004 | Kawahara et al. | 368/64 |
| 7,113,452 | B2 | 9/2006 | Fujita et al. | |
| 7,154,816 | B2 * | 12/2006 | Igarashi et al. | 368/66 |
| 2003/0235117 | A1 | 12/2003 | Ichikawa et al. | |

FOREIGN PATENT DOCUMENTS

| | | | |
|---|---|---|---|
| CH | 684 623 | A3 | 11/1994 |
| EP | 0 886 197 | A1 | 12/1998 |
| EP | 1 026 559 | A1 | 8/2000 |
| EP | 1 113 348 | A2 | 7/2001 |
| EP | 1 115 043 | A2 | 7/2001 |
| EP | 1 225 489 | A1 | 7/2002 |
| EP | 1 750 182 | A1 | 2/2007 |
| GB | 2 016 749 | | 9/1979 |
| JP | 55-022153 | | 2/1980 |
| JP | 10-319150 | | 12/1998 |
| JP | 2002-023285 | A1 | 3/2002 |

* cited by examiner

*Primary Examiner* — Vit W Miska

(57) ABSTRACT

An electronic timepiece with a generator function, including a generating means, a storage means that stores electrical energy produced by the generating means, a timekeeping control means that is driven by the electrical energy stored in the storage means, a time display means that is controlled by the timekeeping control means and displays time, a power generation detection means that detects the power generation state of the generating means, and a power generation display means that displays the power generation state based on a detection result signal output from the power generation detection means. The power generation detection means includes a hand and an actuator that drives the hand in both forward and reverse directions.

19 Claims, 11 Drawing Sheets

ELECTRONIC TIMEPIECE WITH GENERATOR FUNCTION

CROSS-REFERENCE TO RELATED APPLICATIONS

Japanese Patent application No. 2007-065646 is hereby incorporated by reference in its entirety. This application is also related to application Ser. No. 12/047,034, filed on Mar. 12, 2008, now U.S. Pat. No. 7,729,207.

BACKGROUND

1. Field of Invention

The present invention relates to an electronic timepiece with a power generator function.

2. Description of Related Art

Replacing the battery is not necessary with timepieces that have a power generator function, and such timepieces have therefore come into widespread use.

Electronic timepieces with a power generator function store the power produced by the power generator in a secondary battery for use. Japanese Examined Patent Pub. JP-A-S61-61077 teaches a timepiece that has a function for indicating the remaining operating time to the timepiece user, and detecting and displaying how much voltage is left in the secondary battery in order to initiate recharging as may be required.

While the prior art can thus detect the voltage and remaining capacity of the secondary battery, the user is unable to confirm whether the power generator is currently producing sufficient power.

This means that if the timepiece has a manual power generator that produces electricity as a result of the user turning the crown of the timepiece, for example, the secondary battery may not be sufficiently charged because the user does not know whether if sufficient power has been produced. More specifically, when the crown of the timepiece is wound to drive the rotor of the power generator so that the magnetic flux crossing the coil as a result of rotor rotation changes, power cannot be sufficiently generated unless the rotor turns at a sufficiently high speed. This means that the secondary battery may not be sufficiently charged no matter how long the crown is turned if the user winds the crown slowly.

An electronic timepiece with a power generating means according to the present invention enables the user to easily determine the power generation state of the generator.

SUMMARY OF INVENTION

An electronic timepiece with a generator function according to the present invention includes a generating means; a storage means that stores electrical energy produced by the generating means; a timekeeping control means that is driven by the electrical energy stored in the storage means; a time display means that is controlled by the timekeeping control means and displays time; a power generation detection means that detects the power generation state of the generating means; and a power generation display means that displays power generation based on a detection result signal output from the power generation detection means. The power generation detection means includes a hand and an actuator that drives the hand in both forward and reverse directions.

The generating means can be a self-winding generator that rotates a rotor by means a rotary pendulum and converts the rotational energy to electrical energy, a manually wound generator that converts the rotational energy of a rotor that is manually rotated by winding a crown or other operating member to electrical energy, a solar cell that converts light energy to electrical energy, a thermoelectric generator that generates by means of a temperature differential and converts heat energy to electrical energy, or other type of generator.

The actuator can be a stepping motor, a piezoelectric motor, or other type of motor that can drive the hand. The actuator normally simply drives the hand rotationally, but a rack and pinion, for example, could be used to convert torque from the motor to linear drive power to drive the hand linearly.

The power generation detection means can be chosen according to the type of generating means that is used, but preferably can detect the output power of the generating means in real time. For example, if a generator that produces power by driving a rotor to change the magnetic flux crossing the coil is used as the generating means, the output current produced by the generator is an AC current, and a current detection means that detects the output current rectified by a full-wave rectifier circuit can be used.

Because this aspect of the invention has a power generation detection means that detects power generation, and a power generation display means that displays the power generation state based on a detection result signal output from the power generation detection means, the timepiece user can confirm power generation by the generating means in real time, and easily confirm whether sufficient power has been generated. If sufficient power has not been generated, the user can take appropriate action to increase generation and reliably generate sufficient power.

Furthermore, because the power generation display means is provided separately from the time display means, both the time and power generation state can be displayed at the same time, and user convenience is thus improved.

In addition, because a hand that is driven by an actuator is disposed as the power generation display means, the hand can be moved to continuously display the generation state on an analog scale. The generation state can thus be displayed visually in real time similarly to a tachometer used to display engine speed in an automobile, and the user can easily and sensorially determine the power generation state.

Preferably, the power generation detection means samples the current output generated by the generating means at a prescribed sampling rate, and detects the peak output current in each sample.

In this case the relationship between the peak output current and the average current when sampling the output current at the prescribed sampling rate can be predetermined and compiled in a data table. The data table can then be searched to get the average current for the detected peak, and this average can be used as the detected current level.

If the power generation detection means detects the peak output current, the hardware configuration can be simplified by eliminating the need for a capacitor, for example, and power generation can be displayed in real time because there is no delay in the detection process.

In another aspect of the invention the power generation detection means samples the current output generated by the generating means at a prescribed sampling rate, and detects the average output current in each sample.

The average output current can be detected by using a power generation detection means having a resistance in the path from the generating means to the storage means, a capacitor connected parallel to the resistance, and integrating and averaging the current charged to the storage means.

If the power generation detection means detects the average output current, there is no need to use a data table to get the average based on detected peak values, and processing can therefore be simplified. In addition, the actual charge stored in the storage means per unit time can be detected, and the charge can be faithfully displayed.

Yet further preferably, the power generation display means includes an output level detection unit that determines if the detected output current is greater than or equal to a predefined threshold value based on a detection result signal from the power generation detection means, and a drive control unit that drives the actuator to move the hand in a direction toward a first target position when the output level detection unit determines that the output current is greater than or equal to the threshold value, and drives the actuator to move the hand in a direction toward a second target position when the output current is less than the threshold value.

If the hand can move bidirectionally through a prescribed angular range, the first target position and the second target position are preferably at the opposite ends of this range of movement.

This aspect of the invention changes the target positions to which the hand is driven based only on the detection result signal, that is, whether the detected output current is greater than or equal to a set threshold value. Processing is therefore simplified, and the control circuit and control program can be simplified. In addition, operation can be controlled by means of a simple process so that the actual generating state can be easily visually observed, and a display that is easy to read and does appear discordant to the user can be achieved.

In another aspect of the invention a plurality of threshold values are set, and the first target position and the second target position are changed according to the output current level determined by detection and comparison with the threshold values by the power generation detection means.

For example, if the hand can move bidirectionally through a prescribed angular range, one end of the range of movement is the second target position when the generated power output is 0, the other end of the range is the first target position when the generated power output is the maximum output level (MAX), and power generation is between 0 and MAX, the target positions can be set between the ends of the range of movement according to how much power is produced.

The target positions can be fixed at the opposite ends of the movement range of the hand as described above. However, if the target positions are variable as in this aspect of the invention, the output current, which varies in real time, can be faithfully indicated by the hand because movement of the hand changes according to the output current level, and the user can therefore more accurately determine the change in power generation.

In another aspect of the invention at least one of the first target position and the second target position changes according to an integral of the output current detected by the power generation detection means.

For example, the second target position when the output current is 0 is the lower limit when the integral of the output current (generated power) is 0, and as the integral rises, the second target position can be moved closer to the first target position.

This aspect of the invention enables the user to determine substantially simultaneously using a single hand both the momentary output power and the cumulative amount of power generated (the stored charge) since generation started. More specifically, because the hand moves according to the change in the momentary output power, the user can determine power output in real time from the movement of the hand. In addition, because the lower limit of the range of the hand movement, that is, the second target position, moves gradually toward the first target position according to the integral of the output current (generated power), the user can determine the charge accumulated in the storage means from the lower limit of the movement of the hand, which indicates in real time how much power has been produced and stored. Furthermore, because the hand indicates the current power generation level at the same time the second target position moves, the user can substantially simultaneously determine from the action of a single hand both the state of momentary power generation and how much power has been produced since generation started.

Furthermore, by moving the second target position according to the integral of the output current, the user can derive satisfaction from the charging operation by observing the increase in the charge stored in the storage means, and generating power unnecessarily can be prevented.

It will also be obvious that the first target position could be moved instead of the second target position, or both the first target position and the second target position could be moved.

In another aspect of the invention the drive control unit interrupts driving based on the previous determination when the output level detection unit outputs a result that is different from the previous determination, and moves the hand to a new target position based on the current determination.

This aspect of the invention can move the hand with good response according to generator output at the sampling time, improves the response of the hand when power is produced by the user manually winding the generator, and affords a satisfying response to the winding action of the user.

More particularly, while the speed at which a motor that is small enough to fit into a wristwatch can move the hand is limited to a degree, if the sampling rate (sampling frequency) is appropriately set and combined with the process of the invention, movement of the hand can accurately track the generated power by manually winding the generator, and user can be afforded an extremely satisfying response to the user's action.

In another aspect of the invention the drive control unit moves the hand to a display position that is set based on an integral of plural detection result signals or based on an average of plural detection result signals from the power generation detection means.

If the display position of the hand is set based on the integral or average of a plurality of detection result signals, the effect of transient fluctuations can be reduced and a stable power generation display can be achieved.

In another aspect of the invention the drive control unit changes the speed at which the hand moves according to the direction of movement.

This aspect of the invention enables moving the hand more slowly when the power output drops, that is, when the hand moves from the first target position toward the second target position, than when the output power increases, that is, when the hand moves from the second target position toward the first target position.

When a hand or needle indicator that points to a measured value moves back and forth like a tachometer, the hand appears to the user to move more smoothly when the hand moves quickly towards the high end of the scale and more slowly towards the low end of the scale, and this motion is sensorially satisfying. More particularly, if the hand moves more quickly when power output increases in the manual power generation mode, the hand appears to move with good response to the manual winding operation and prompts the user to continue generating power. As a result, the timepiece user continues the winding operation to increase the power output, and sufficient power can be generated in a short time.

In another aspect of the invention the power generation display means normally uses the hand to display other information, and changes to a power generation display when electrical power is produced by the generating means.

This aspect of the invention enables using the hand of the power generation display means to also display other information and thus simplifies the arrangement of the timepiece because more information can be displayed without increasing the number of hands.

In another aspect of the invention the power generation display means normally uses the hand to display other information, and changes the hand to the power generation display mode when the power generation detection means detects a prescribed power output level.

This aspect of the invention enables changing the display mode based only on whether a prescribed output power, such as an output current greater than or equal to a prescribed threshold value I4, is detected, and thus enables changing the display mode quickly. More particularly, when the power generated by a manually wound generator that produces power when the user winds the crown, for example, is displayed, detection of the prescribed output power indicates there is a high likelihood that the user is manually generating the power. The hand can therefore be quickly changed to the power generation display mode to indicate the power generation state for the user.

In another aspect of the invention the power generation display means normally uses the hand to display other information, and changes the hand the power generation display mode when a state in which generating a prescribed output power within a prescribed time continues for a prescribed time or longer.

This aspect of the invention displays the power generation state when power is generated continuously for a certain period of time, and indicates the power generation status only when power is generated. Power output can therefore be reliably detected and displayed when a prescribed charge is produced continuously for an extended time, such as when a solar generator or a generator that uses an external AC field is used as the generating means.

In another aspect of the invention the power generation display means normally uses the hand to display other information, and changes the hand to a power generation display mode when generating a prescribed output level in one generation cycle occurs a prescribed number of times within a prescribed period.

This aspect of the invention changes to the power generation display mode only after a prescribed charge has been generated a plural number of times. As a result, when both a self-winding generator that uses a rotary pendulum to drive the rotor of the generator, and a manually wound generator in which the rotor of the generator is driven by manually winding a crown, for example, are used, this aspect of the invention impedes switching to the power generation display mode when power is produced by the self-winding generator, facilitates switching to the power generation display mode when power is produced by manual winding, and thus displays the generated power only when it can be easily confirmed by the user.

More specifically, a self-winding generator produces power as a result of movement of the wrist on which the wristwatch is worn causing the rotary pendulum to turn, and the user is thus normally unaware that power is being generated. The generated output power and interval at which power is produced are therefore not constant, and the likelihood of the above conditions being met is low. In the case of manual generation, however, power is produced intentionally by the user, and the condition of a prescribed amount of power produced by a single generation cycle a prescribed number of times within a prescribed period is easily satisfied. In addition, because the user is most likely not aware when power is produced by the self-winding generator, it is not necessary to switch to the power generation display mode, and by not changing to the power generation display mode the power required to drive the hand in the power generation display mode is not consumed. However, by changing to the power generation display mode when the generator is wound manually, the user can easily verify the generation state and usability is therefore improved.

In another aspect of the invention the power generation display means normally uses the hand to display other information, and changes the hand to a power generation display mode when a prescribed output level is generated in one generation cycle and generating a prescribed output level is then detected within a prescribed time.

This aspect of the invention changes to the power generation display mode only once a prescribed output level is detected within a prescribed time after a prescribed output level is generated. As a result, when both a self-winding generator that uses a rotary pendulum to drive the rotor of the generator, and a manually wound generator in which the rotor of the generator is driven by manually winding a crown, for example, are used, this aspect of the invention impedes switching to the power generation display mode when power is produced by the self-winding generator, facilitates switching to the power generation display mode when power is produced by manual winding, and thus displays the generated power only when it can be easily confirmed by the user. Therefore, by not changing to the power generation display mode when power is produced by the self-winding generator, consumption of the power required to drive the hand in the power generation display mode is eliminated. However, by changing to the power generation display mode when the generator is wound manually, the user can easily verify the generation state and usability is therefore improved.

An electronic timepiece according to another aspect of the invention preferably also has an external operating member. The power generation display means normally uses the hand to display other information, and changes the hand to a power generation display mode when a specific operation of the external operating member is detected.

This aspect of the invention enables changing the display mode reliably as intended by the user. As a result, power generation is displayed only when the user wants to confirm the power generation state, prevents displaying the power generation state unnecessarily, and saves power.

An electronic timepiece according to another aspect of the invention preferably also has an external operating member; and a switch that detects operation of the external operating member. The power generation display means normally uses the hand to display other information, and changes the hand to a power generation display mode when the switch detects operation of the external operating member.

This aspect of the invention enables changing the display mode reliably as intended by the user. As a result, power generation is displayed only when the user wants to confirm the power generation state.

In another aspect of the invention the power generation display means normally uses the hand to display the remaining continuous operating time of the timepiece.

The continuous operating time as used herein means the time that the electronic timepiece can be driven continuously using the electrical energy stored in the storage means, and more specifically means the continuous operating time until the timekeeping control means stops the time display means. If the timekeeping control means rendered by an IC and crystal oscillator stops in an electronic timepiece with a power generator function stops, the storage means must be recharged to the voltage at which driving the IC can start, and a specific amount of time is required for operation of the crystal oscillator to stabilize. Restarting operation of the timekeeping control means is therefore relatively time-consuming. A sleep mode is therefore usually activated when the voltage stored in the storage means drops to a prescribed level so that driving only the IC and crystal oscillator of the timekeeping control means continues and driving the time display means, which typically includes a motor or liquid crystal display, stops. The continuous operating time of this electronic timepiece with a generator function therefore means the remaining continuous operating time until the sleep mode is activated.

This aspect of the invention enables the user to know approximately how long the timepiece can continue operating without power being generated, and enables preventing the timepiece from stopping by executing the generating operation before the timepiece stops.

Furthermore, while the same hand is used to display power generation and to display the continuous operating time, there is a strong correlation between power generation and the continuous operating time, and both belong to the same category of information. The user can therefore easily interpret the information even if the same hand is used to indicate both, and usability is improved.

In another aspect of the invention the power generation display means returns to the normal display mode if the generated output power is not at least a prescribed level for a prescribed time or longer when power generation is being displayed.

This aspect of the invention automatically restores the display when power is no longer being produced and displaying the generated output power is not necessary, eliminates the need for the user to reset the display mode, and thus improves usability.

In another aspect of the invention the power generation display means returns to the normal display mode at a prescribed time after switching to the power generation display mode.

This aspect of the invention enables resetting the display by simply checking how much time has passed since changing to the power generation display mode, and can thus be achieved by a simple arrangement. Furthermore, by confirming whether the display is in the power generation display mode or has been reset to the normal display mode, the approximate time since changing to the power generation display mode can also be confirmed.

The electronic timepiece with a power generating means according to the present invention has the effect of enabling the user to easily determine the power generating state of the power generator.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of the present invention are described below with reference to the accompanying figures.

General Configuration of an Electronic Timepiece

Figure 1:
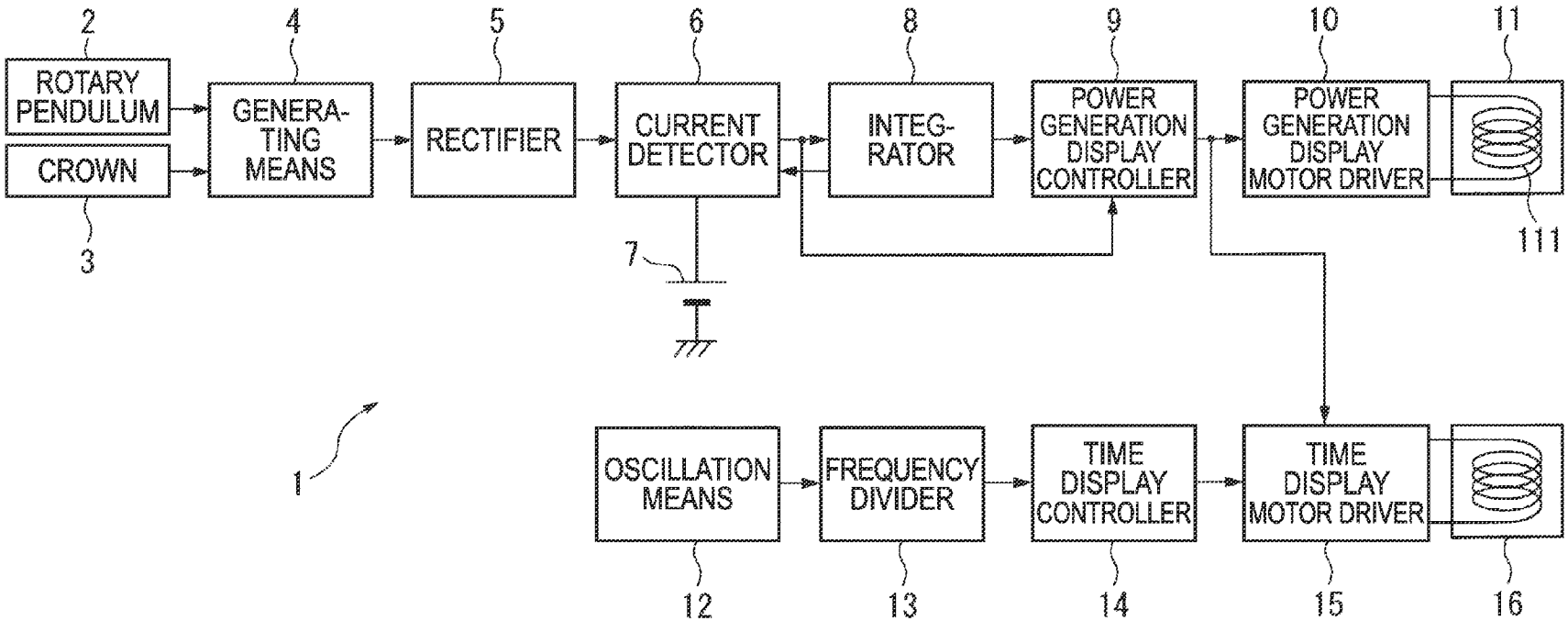
FIG. 1 is a block diagram of an electronic timepiece with a generator function according to a preferred embodiment of the present invention.

As shown in FIG. 1, an electronic timepiece 1 according to the present invention has a rotary pendulum 2, a crown 3, a generating means 4, a rectification means 5, a current detection means 6, a secondary battery 7 as a power storage means, an integration means 8, a power generation display control means 9, a power generation display motor driving means 10, a power generation display motor 11, an oscillation means 12, a frequency division means 13, a time display control means 14, a time display motor driving means 15, and a time display motor 16.

Figure 2:
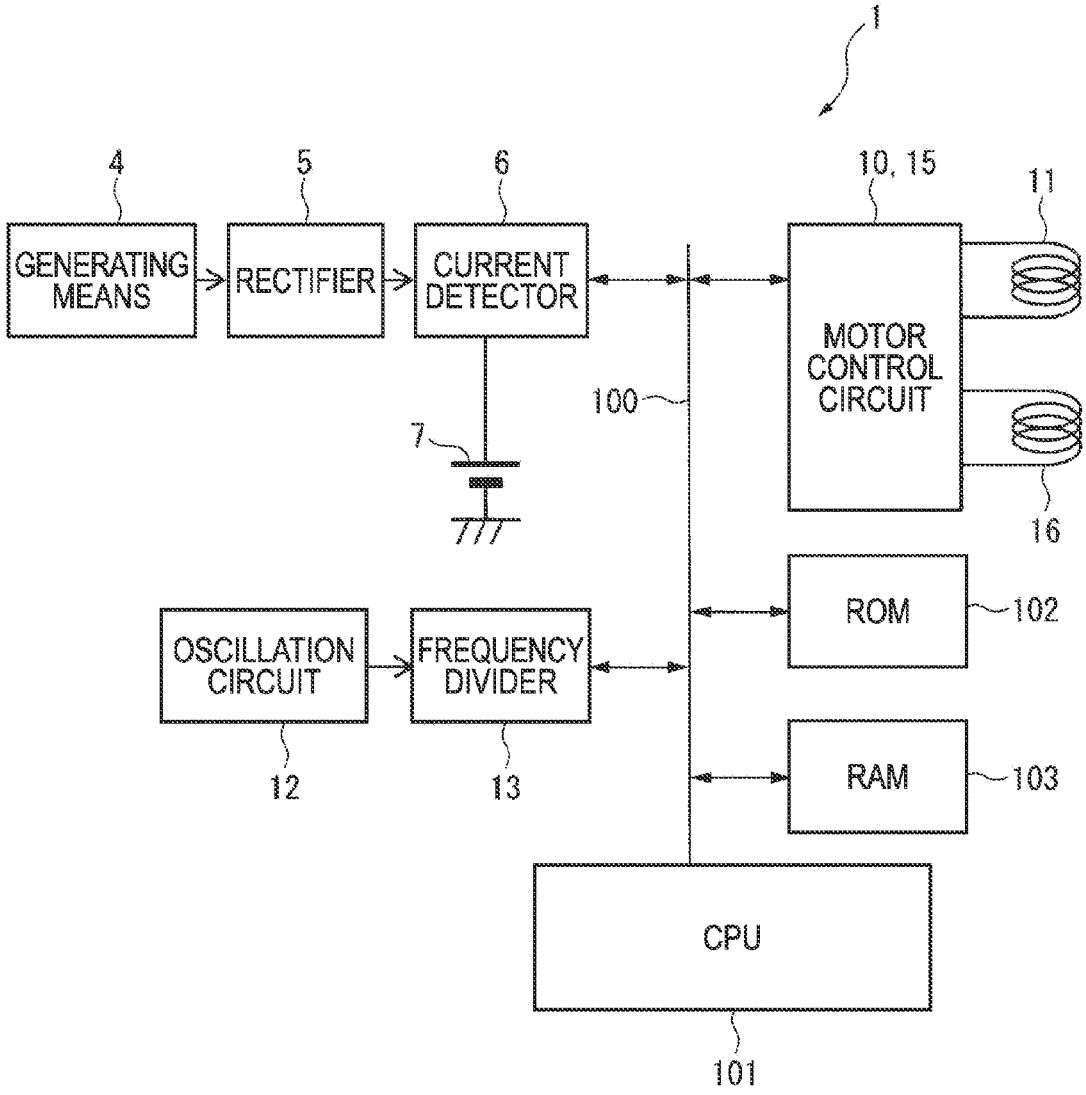
FIG. 2 is a circuit block diagram of the electronic timepiece in the preferred embodiment of the invention.

As shown in the hardware schematic in FIG. 2, the current detector 6 (current detection circuit), frequency divider 13 (frequency division circuit), and the motor drive means 10 and 15 (motor control circuits) are connected to a CPU 101 (central processing unit), ROM 102 (read-only memory), and RAM 103 (random access memory) by a bus 100 to enable data input and output therebetween.

In this embodiment of the invention the integrator 8, power generation display controller 9, and time display controller 14 are achieved by running specific software applications using the CPU 101, ROM 102, and RAM 103.

Figure 3:
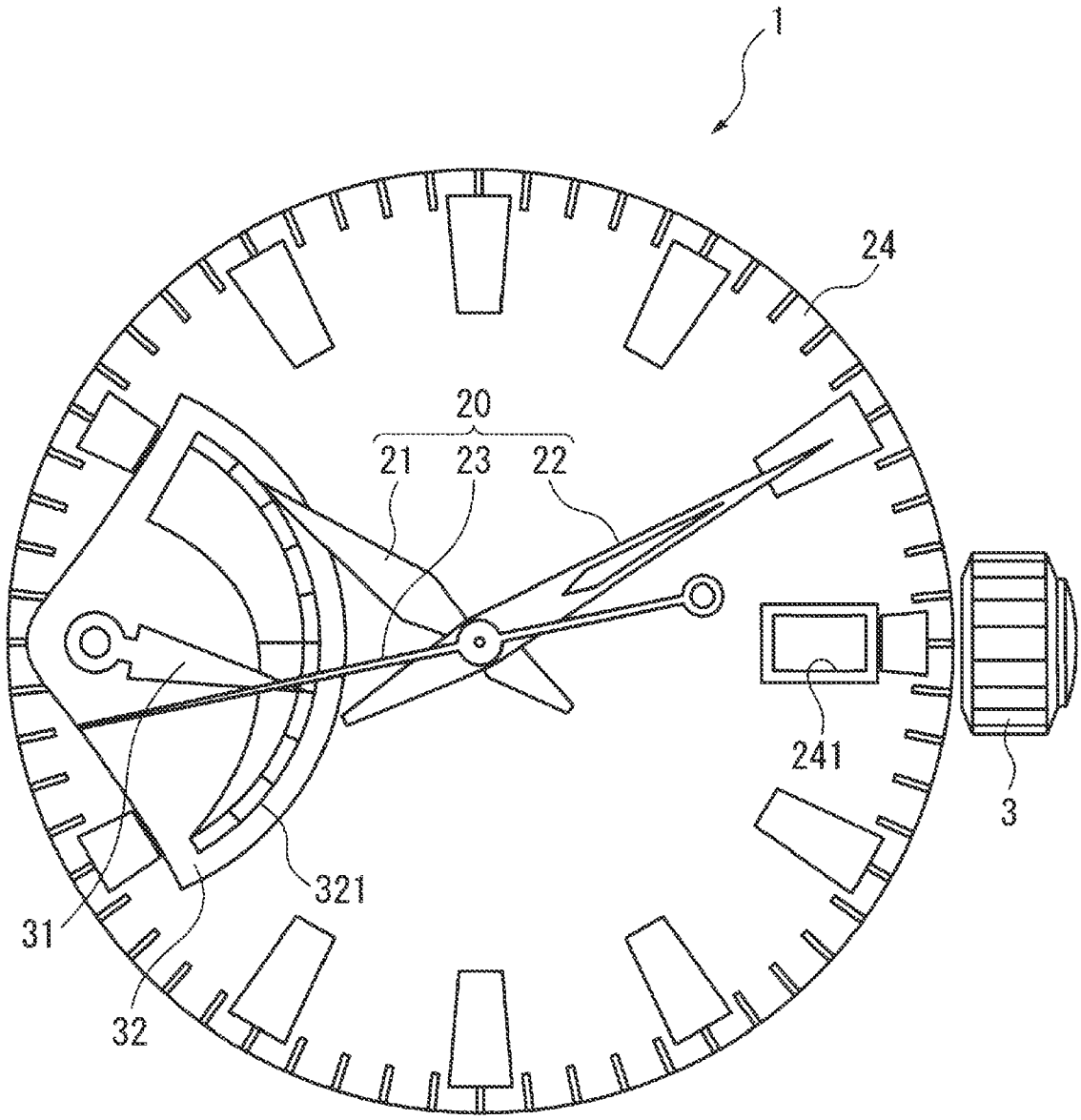
FIG. 3 shows the dial portion of the electronic timepiece in the preferred embodiment of the invention.

As shown in FIG. 3, the electronic timepiece 1 has hands 20 including an hour hand 21, a minute hand 22, and a second hand 23 for indicating the time. The hands 20 are driven by the time display motor 16.

A power generation dial 32 and a display hand (auxiliary hand) 31 that is separate from the hands 20 for indicating the time and is used to indicate power generation are disposed at the 9:00 o'clock position on the dial 24 of the electronic timepiece 1. The display hand 31 is driven by the power generation display motor 11.

A window 241 is formed at the 3:00 o'clock position of the dial 24, and the date can be displayed by a date wheel disposed behind the dial 24. The date wheel is driven rotationally by a date wheel motor not shown.

In the electronic timepiece 1 thus comprised the timepiece control means of the invention is rendered by the oscillation means 12, the frequency divider 13, and the time display controller 14, and the time display means is rendered by the time display motor driver 15, the time display motor 16, and the hands 20.

The power detection means of the invention is rendered by the current detector 6 and the integrator 8. The generation state display means is rendered by the power generation display controller 9, the power generation display motor driver 10, the power generation display motor 11, the display hand 31, and the power generation dial 32. The hand of the generation state display means is rendered by the display hand 31, and the actuator is rendered by the power generation display motor driver 10 and the power generation display motor 11.

The generation level detection unit that determines if the detected generator current is greater than or equal to a specific threshold level, and a drive control unit that controls driving the display hand 31, are rendered as functions of the power generation display controller 9, and in this embodiment of the invention the generation level detection unit and the drive control unit are rendered by the power generation display controller 9.

Power Generation Means

Figure 4:
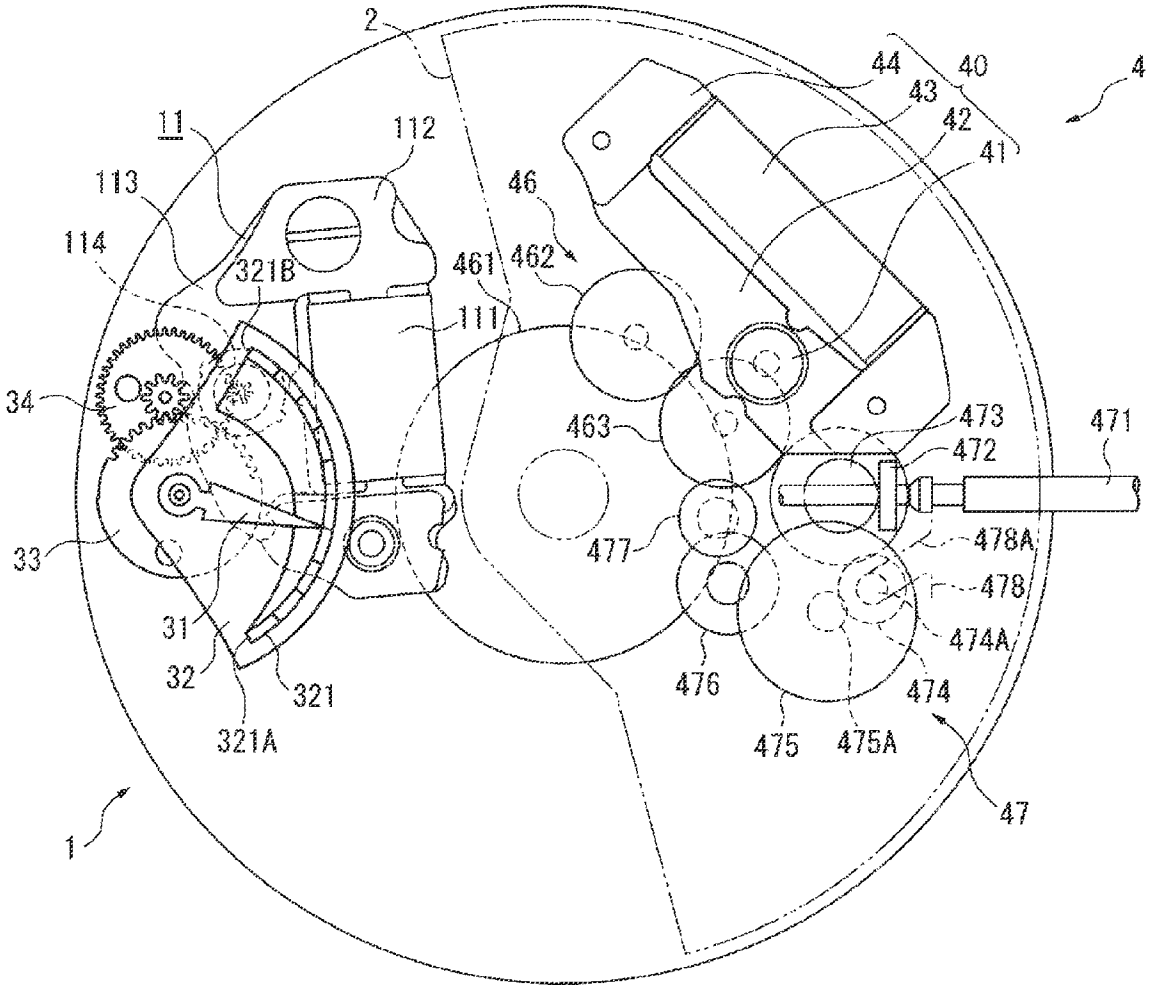
FIG. 4 shows the arrangement of the generating means and the power generation display means in the preferred embodiment of the invention.
Figure 5:
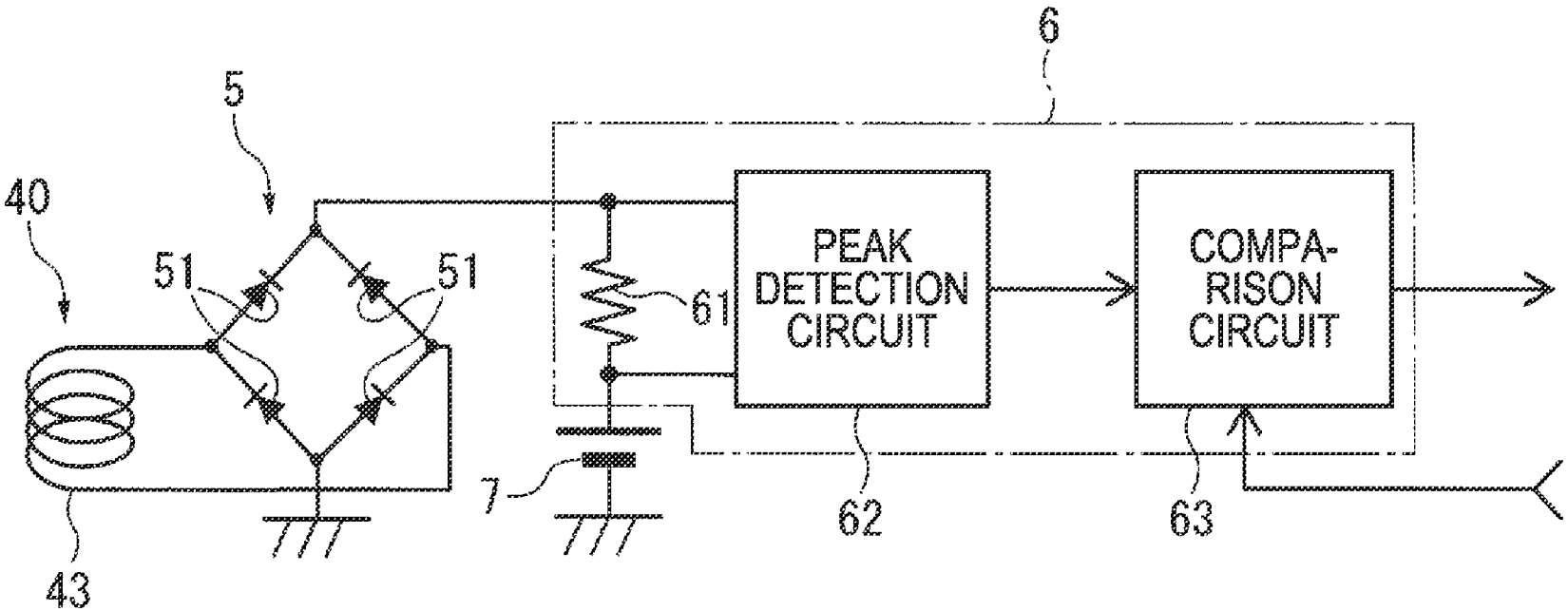
FIG. 5 is a circuit diagram showing of the rectifier means and current detection means in the preferred embodiment of the invention.

As shown in FIG. 4, the generating means 4 enables generating power using a self-winding generator that is driven by the rotary pendulum 2 disposed inside the case of the electronic timepiece 1, or using a manually wound generator that is driven by the crown 3.

More specifically, the generating means 4 includes a generator 40, a self-winding transfer means 46, and a manual winding transfer means 47. The self-winding transfer means 46 transfers mechanical energy from the rotary pendulum 2 to the generator 40. The manual winding transfer means 47 transfers mechanical energy from the crown 3 to the generator 40.

The generator 40 is a common alternating current generator including a rotor 41, a stator 42, a coil 43, and a coil block 44. The rotor 41 is rotatably disposed to the stator 42, and the coil 43 is wound to the coil block 44.

The self-winding transfer means 46 includes a rotary pendulum wheel 461 that rotates in unison with the rotary pendulum 2, and a pair of switching wheels 462 and 463 to which rotation of the rotary pendulum wheel 461 is transmitted. One switching wheel 463 meshes with the pinion of the rotor 41 so that torque from the rotary pendulum 2 is transferred through the rotary pendulum wheel 461 and switching wheels 462 and 463 to the rotor 41 so that the generator 40 produces power.

The pair of switching wheels 462 and 463 have a ratchet wheel not shown so that the rotor 41 only turns in one direction regardless of which direction the rotary pendulum wheel 461 turns.

The manual winding transfer means 47 includes a winding stem 471, a winding pinion 472, a crown wheel 473, a clutch wheel 474, a first manual winding transfer wheel 475, a second manual winding transfer wheel 476, a third manual winding transfer wheel 477, and the switching wheel 463.

The crown 3 is attached to the end of the winding stem 471 so that the winding stem 471 turns when the user turns the crown 3. Rotation of the winding stem 471 is transmitted to the clutch wheel 474 by the intervening winding pinion 472 and crown wheel 473, rotation of the clutch wheel 474 is transmitted to the first manual winding transfer wheel 475, and rotation of the first manual winding transfer wheel 475 is transmitted to the switching wheel 463 by the intervening second manual winding transfer wheel 476 and third manual winding transfer wheel 477.

The clutch wheel 474 engages the pinion 475A of the first manual winding transfer wheel 475 only when the winding stem 471 turns in one direction. More specifically, a slot 478A is formed in the bridge 478 to which the clutch wheel 474 is disposed, and the support pin 474A of the clutch wheel 474 is fit freely slidably in this slot 478A. Referring to FIG. 4, when the stem is wound and the crown wheel 473 turns clockwise, the clutch wheel 474 rotates counterclockwise while moving toward the center of the first manual winding transfer wheel 475 to engage the pinion 475A. When the first manual winding transfer wheel 475 turns counterclockwise due to drive power from the switching wheel 463, the clutch wheel 474 separates from the pinion 475A while turning clockwise and thus disengages the first manual winding transfer wheel 475. As a result, rotation of the rotary pendulum 2 is not transmitted to the winding stem 471.

Rectification Means

The rectifier 5 rectifies the AC current output from the generator 40, and can be rendered using a known rectification circuit such as a full-wave rectifier circuit or a half-wave rectifier circuit.

In this embodiment of the invention the rectifier 5 is rendered by a bridge rectification circuit (full-wave rectifier circuit) using four diodes 51.

Current Detection Means

The current detector 6 detects the level of the current rectified by the rectifier 5.

More specifically, the current detector 6 has a resistor 61, a peak detection circuit 62, and a comparison circuit 63. The resistor 61 is disposed between the rectifier 5 and the secondary battery 7. The peak detection circuit 62 measures the current flowing through the resistor 61 and detects the current generation peak. The comparison circuit 63 then compares the peak value detected by the peak detection circuit 62 with a threshold value.

Figure 6:
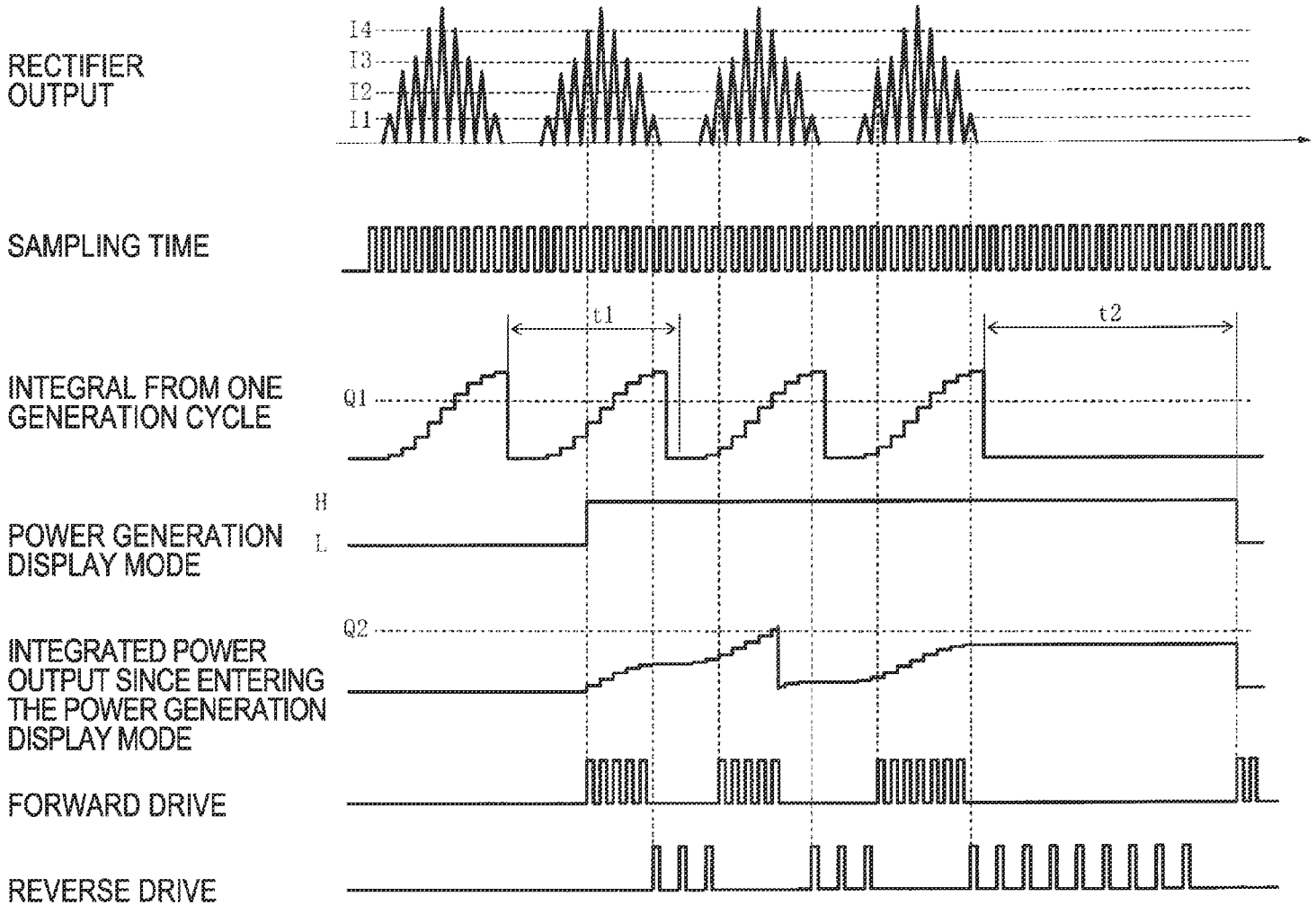
FIG. 6 is a timing chart showing the relationship between power generation, the power generation integral, and the motor drive pulse in the preferred embodiment of the invention.

The current detector 6 is driven at a prescribed sampling rate (sampling period) by a signal from the CPU 101 and samples the charge current As shown in FIG. 6, the peak detection circuit 62 samples the generated current output from the rectifier 5 and detects the peak value of each sample. The comparison circuit 63 compares the peak value detected by the peak detection circuit 62 with prescribed threshold values, such as threshold values I1 to I4 in FIG. 6, and outputs a detection result signal to the integrator 8 and the power generation display controller 9.

The comparison circuit 63 in this embodiment of the invention is arranged so that the threshold value level, that is, the detection level, can be changed by a signal from the CPU 101 based on the integral of the integrator 8, for example.

Power Storage Means

The power storage means of the invention is rendered by a secondary battery 7 that can be charged by the generated current. The output of the generator 40 is rectified by the rectifier 5 and stored in the secondary battery 7 through the intervening current detector 6. The power storage means is not limited to a secondary battery 7, and a capacitor can be used instead.

Integration Means

The integrator 8 calculates the average current based on the detection result signal output from the current detector 6, and integrates the average current values.

More specifically, the relationship between the generated current peak detected from each sample and the average current level at each peak is predetermined experimentally, and stored in a correlation table in ROM 102. The integrator 8 finds the average current level corresponding to the detection result signal (peak) output from the current detector 6, and integrates the average current values.

The integrator 8 has a power generation counter, a power generation display state counter, and a continuous operating time counter. The counters are rendered in RAM 103.

As shown in FIG. 6, the power generation counter is a counter that integrates the average current each time power is generated and stores the integral (generated power output) of the single generation cycle. As described below, this counter is provided because one condition for going to the power generation display state is whether the power output from the one generation cycle integrated by the power generation counter is greater than or equal to a threshold value Q1.

The power generation display state counter integrates and stores the average current after the power generation display mode described below. As shown in FIG. 6, the power generation display state counter is reset when the generated power output exceeds a threshold value Q2.

The continuous operating time counter counts the continuous operating time of the electronic timepiece 1, and steps up the continuous operating time that is displayed during normal operation a one-day increment each time the integral of the generated current (generated power) reaches the preset value for the amount of power to be generated in one day. When current consumption by the electronic timepiece 1 reaches the amount consumed in one day, the cumulative value stored in the continuous operating time counter is reduced, and the continuous operating time display is stepped down a one-day increment each time the continuous operating time becomes one day shorter.

These one-day amounts of power generation and current consumption can be set by measuring the current consumption of the electronic timepiece 1 and calculating power consumption per day, and setting the per-day power generation based on the measured power consumption. This can be difficult to achieve in a small electronic timepiece 1 such as a wristwatch, however, because it requires incorporating a circuit for measuring current consumption.

In this embodiment of the invention, therefore, the typical per-day current consumption of the electronic timepiece 1 is measured and calculated in the factory, and the required daily power generation corresponding to the calculated power consumption is preset and stored in ROM 102, for example. Each time the movement of the electronic timepiece 1 advances normally one day, the amount of current consumed per day is assumed to have been consumed and the continuous operating time counter is decremented one day.

When the electronic timepiece 1 has a high-current-consumption function other than the function for normal movement control, the current consumption per unit time can be preset for each such function, and current consumption can be corrected by multiplying the current consumption per unit time by how long the function is used. For example, if the electronic timepiece 1 has a radio-controlled time correction function that adjusts the time by receiving a radio signal, current consumption during the signal reception process and the time adjustment process can be preset, and the continuous operating time can be corrected based on the calculated power consumption.

Power Generation Display Control Means

The power generation display controller 9 controls the power generation display motor driver 10 based on output from the current detector 6 and the integrator 8. More specifically, during normal operation the power generation display controller 9 reads the continuous operating time counter of the integrator 8, and controls the power generation display motor driver 10 so that the display hand 31 indicates the stored count, that is, the continuous operating time.

One graduation of the power generation dial 32 in this embodiment of the invention is equal to a continuous operating time of one day. When the continuous operating time counter is stepped up as a result of generating power as described above, the power generation display motor driver 10 moves the display hand 31 one graduation counterclockwise. When power is consumed and the continuous operating time counter is decremented one step, the power generation display motor driver 10 moves the display hand 31 clockwise one graduation.

If power is generated continuously by manually winding the stem, the power generation display controller 9 switches the display hand 31 from the normal continuous operating time display to the power generation display mode. This operation is described in detail below.

Power Generation Display Motor Drive Means

The power generation display motor driver 10 outputs a drive pulse to the motor coil 111 of the power generation display motor 11 to control driving the power generation display motor 11 based on a drive control signal output from the power generation display controller 9.

Power Generation Display Motor and Display Hand 31 Drive Wheel Train

As shown in FIG. 4, the power generation display motor 11 has a coil block 112 to which the motor coil 111 is wound, and a stator 113 to which a rotor 114 is disposed to rotate freely.

An intermediate wheel 34 meshes with the rotor pinion of the rotor 114, and a display wheel 33 meshes with the pinion of the intermediate wheel 34. The display hand 31 is attached to the display wheel 33.

The display wheel 33 has teeth formed to only a part of the outside edge of the wheel, and can be rotated only within a prescribed angular range by the power generation display motor 11. The display hand 31 that is attached to the display wheel 33 can therefore also rotate only through a prescribed angular range.

The power generation dial 32 is a flat fan shape, and a scale 321 is formed in an arc along the path of the distal end of the display hand 31.

The scale 321 is divided into ten segments ranging from a zero graduation 321A denoting hand position 0 to a tenth graduation 321B denoting hand position 10. The scale 321 therefore has eleven index marks from hand position 0 to hand position 10, and can indicate eleven states.

When the display hand 31 is used as a continuous operating time hand indicating the remaining continuous operating time, each graduation represents a continuous operating time equal to one day, and a maximum continuous operating time of ten days can be indicated.

More specifically, when the count of the continuous operating time counter goes to 0 days, the display hand 31 points to the zero graduation 321A, and when the count goes to one day, the display hand 31 points to the first graduation. As the count thereafter increases one day, the display hand 31 points to the second to tenth graduations. If the continuous operating time is more than ten days, the display hand 31 continues pointing to the tenth graduation 321B because the scale only covers ten days.

In this embodiment of the invention the tenth graduation 321B is set as the first target position toward which the display hand 31 moves in the power generation display mode. The second target position is set to the not-generating display position, which is the position indicated by the display hand 31 when the generator is not producing power and changes according to the integral of generator output after the power generation display mode is entered as described below.

Timepiece Control Means and Time Display Means

The timepiece control means and time display means for displaying the regular time are the same as in a common analog quartz timepiece, and detailed description thereof is omitted below.

More specifically, the oscillation means 12 is a crystal oscillator, for example, that outputs a signal of a prescribed frequency. The frequency divider 13 frequency divides the signal from the oscillation means 12, and outputs a 1-Hz reference signal in this embodiment of the invention.

The time display controller 14 outputs a drive signal to the time display motor driver 15 based on the reference signal from the frequency divider 13. The drive signal is normally output each time the 1-Hz reference signal is output from the oscillation means 12. The time display motor driver 15 inputs to the motor coil of the time display motor 16 based on the drive signal, and the time display motor 16 moves the hands 20 in steps.

A control signal from the power generation display controller 9 causes the time display motor driver 15 to enter a sleep mode that stops movement of the hands 20 when the remaining continuous operating time goes to 0.

The operation of the electronic timepiece 1 according to this embodiment of the invention is described next with reference to the flow charts in FIG. 7 to FIG. 9.

The control described by these flow charts is executed at each sampling time shown in FIG. 6.

When operation of the electronic timepiece 1 starts, the CPU 101 executes a process that causes the current detector 6 to sample power generation and return the current detection result (step S1). If the generating means 4 generates power as a result of movement of the rotary pendulum 2 or crown 3, the resulting current (charge current) flows through the rectifier 5 to the secondary battery 7 and is detected by the current detector 6. As a result, the detection result signal indicating the current peak of each sample, or more specifically a signal denoting the result of comparison with the threshold levels I1 to I4 as shown in FIG. 6, is output from the current detector 6.

The integrator 8 then integrates the detection result signal of the current detector 6 (step S2). The power generation display controller 9 then determines if the display hand 31 is currently in the normal display mode or the power generation display mode (step S3). The normal display mode is the mode in which the continuous operating time is displayed as described above.

If in step S3 the power generation display controller 9 determines that the display hand 31 is not operating in the power generation display mode (step S3 returns No), the power generation display controller 9 determines whether the conditions for switching to the power generation display mode have been met in steps S4 to S6 as described below.

The power generation display controller 9 first determines if the charge current is greater than a predefined threshold value I3 (step S4).

If step S4 returns Yes, the power generation display controller 9 determines if the time passed since the end of the last power generation cycle is less than or equal to a predefined time t1 (step S5).

If step S5 returns Yes, the power generation display controller 9 determines if the integral of the previous power generation (the amount of power produced in the one generation cycle) is greater than or equal to a predefined value Q1 (step S6).

If step S6 returns Yes, the condition for switching to the power generation display mode is met and the power generation display controller 9 switches to the power generation display mode (step S7).

More specifically, as shown in FIG. 6, the condition for switching to the power generation display mode in this embodiment of the invention is that the charge current is greater than or equal to I3, power generation from the previous single winding (the amount of power generated from when the current detection result went from greater than I1 to less than I1) is greater than or equal to Q1, and the time passed since the end of the last power generation cycle (the time since the current detection result went to I1 or less) is less than or equal to predefined time t1.

This condition prevents switching to the power generation display mode when power is generated irregularly and the amount of power produced is low, such as when power is not generated intentionally by the user but is generated automatically by the self-winding operation of the rotary pendulum 2 and the user is not aware that power is being generated.

Because of these switching conditions, if the user turns the crown 3 at a prescribed speed or faster, for example, the display changes at the second revolution as shown in FIG. 6 (at the timing when the power generation display mode goes from L to H in FIG. 6). More specifically, because the crown cannot be turned continuously when the user rotates the crown 3, the crown 3 turns intermittently and the generated current rises and falls with each revolution. Detecting the current generated in this case at the prescribed sampling time results in the rectifier circuit output as shown in FIG. 6.

When the power generation display mode is entered the power generation display controller 9 sets the not-generating display position, which is the second target position noted above, to the initial value 0 (zero graduation 321A) (step S8), and then goes to the power generation display process (step S10).

If any of steps S4, S5 and S6 returns No, however, the conditions for switching to the power generation display mode are not met, and the power generation display controller 9 ends the process and continues the normal display mode.

If the power generation display mode has already been selected in step S3 (step S3 returns Yes), control goes to the power generation display process (step S10) and the power generation display mode continues.

When control goes to the power generation display process (step S10), the power generation display controller 9 causes the integrator 8 to calculate the amount of power generated since the power generation display mode was entered, and determines if the integral is greater than a predefined threshold value Q2 (step S11).

If step S11 returns Yes, the power generation display controller 9 determines if the not-generating display position is set to the maximum graduation on the dial (the tenth graduation 321B in this embodiment of the invention) (step S12). If the not-generating display position is not set to the maximum graduation, the not-generating display position is incremented by 1 (step S13), and the integral calculated by the integrator 8 since entering the power generation display mode is reset (step S14). The integral in the power generation display mode is also reset (step S14) if the not-generating display position is set to the maximum graduation in step S12.

Each time generator output (charge) exceeds Q2 after entering the power generation display mode, the not-generating display position (the graduation indicated by the hand) is incremented one graduation until it reaches the maximum graduation 10 on the dial (the tenth graduation in this embodiment of the invention).

After step S14 or if step S11 returns No, the power generation display controller 9 determines if the charge current is greater than or equal to threshold value I2 (step S15).

If the charge current is greater than or equal to I2, whether the display hand 31 is moving in reverse is determined (step S16).

Note that in this embodiment of the invention the display hand 31 is considering to be moving forward when it is moving in the direction from the zero graduation 321A toward the tenth graduation 321B, that is, the first target position, and is considered to be moving in reverse when the display hand 31 is moving in the opposite direction from the tenth graduation 321B toward the zero graduation 321A, that is, the second target position.

If step S16 returns Yes, the display hand 31 is stopped from moving in reverse (step S17) and the display hand 31 is moved forward toward the tenth graduation 321B (step S18). The power generation display process of step S10 then ends.

However, if step S16 returns No, the power generation display controller 9 determines if the display hand 31 is moving forward (step S19).

If step S19 returns Yes, the power generation display controller 9 continues forward movement of the display hand 31 (step S20), and the power generation display process of step S10 ends.

If step S19 returns No, that is, the display hand 31 is stationary and not moving forward or reverse, the power generation display controller 9 determines if the display hand 31 is at the maximum scale position 10 (tenth graduation 321B) (step S21).

If step S21 returns Yes, the display hand 31 is at the maximum graduation in the forward direction and cannot move any further forward. The power generation display process of step S10 therefore ends.

However, if step S21 returns No, such as when the display hand 31 is indicating the continuous operating time, the display hand 31 is moved forward toward the maximum dial position 10 (step S18), and the power generation display process of step S10 ends.

Figure 9:
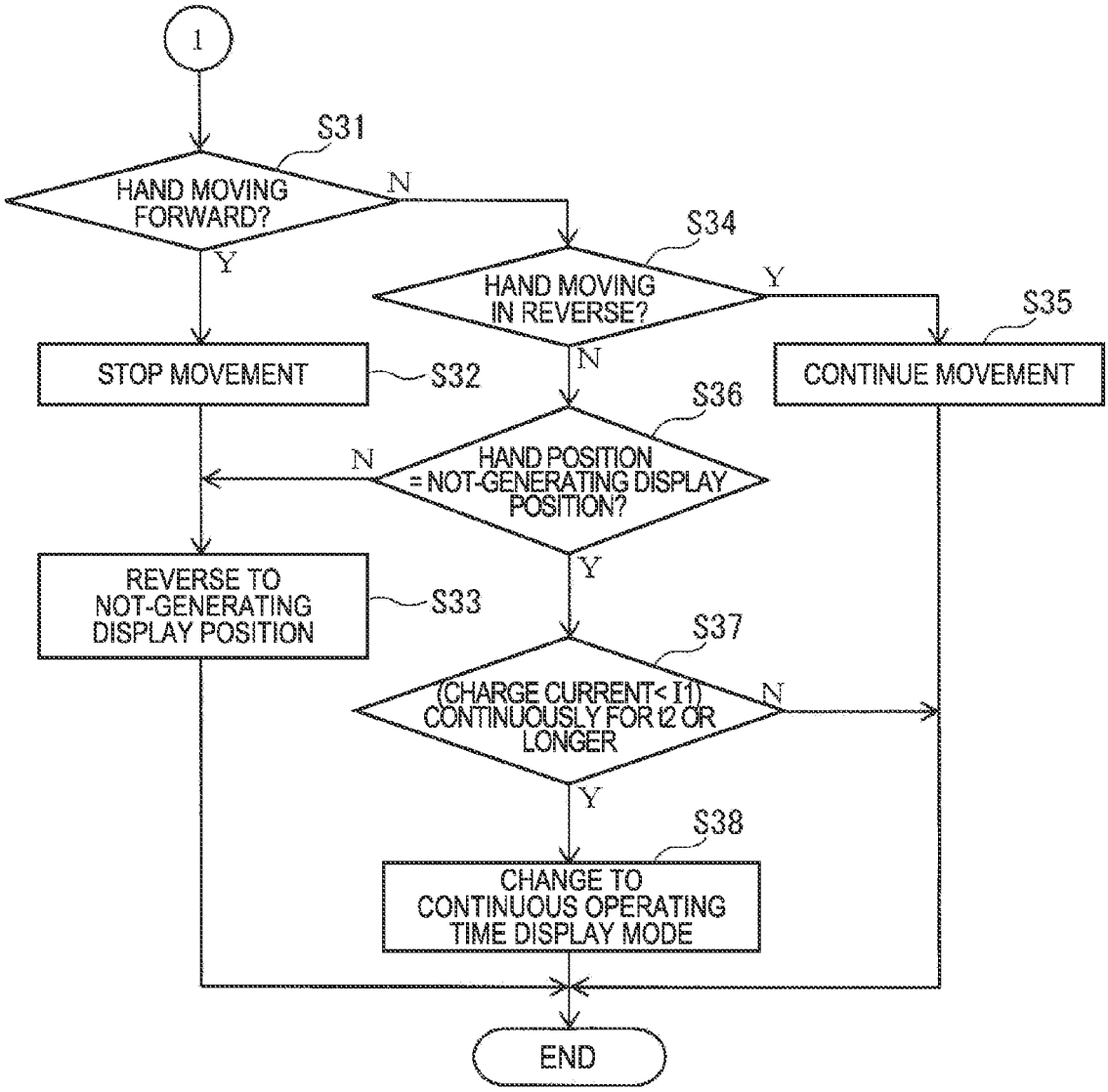
FIG. 9 is a flow chart of the power output display process in FIG. 7.

If step S15 returns No, the power generation display controller 9 determines if the display hand 31 is moving forward as shown in FIG. 9 (step S31).

If step S31 returns Yes, the display hand 31 is stopped from moving forward (step S32) and the display hand 31 is moved in reverse toward the not-generating display position (step S33). The power generation display process of step S10 then ends.

If step S31 returns No, the power generation display controller 9 determines if the display hand 31 is moving in reverse (step S34).

If step S34 returns Yes, the power generation display controller 9 continues reverse movement (step S35) and the power generation display process of step S10 then ends.

If step S34 returns No, that is, the display hand 31 is stationary and not moving forward or reverse, the power generation display controller 9 determines if the display hand 31 is at a not-generating display position (step S36).

If step S36 returns Yes, the power generation display controller 9 determines if the charge current has been less than I1 continuously for a prescribed time t2 or longer (step S37).

If step S37 returns Yes, the power generation display controller 9 can determine that power is not being generated, therefore switches to the continuous operating time display mode (step S38), and the power generation display process of step S10 ends.

However, if step S37 returns No, the power generation display process of step S10 ends with the display hand 31 held at the not-generating display position. Because the not-generating display position increments one graduation each time the calculated generator output goes to Q2 in steps S11 to S14, the amount of power generated (stored) by the current generation cycle is indicated by the display hand 31 and can be read by the user.

If step S36 returns No, such as when the display hand 31 is displaying the continuous operating time, the display hand 31 is moved in reverse toward the not-generating display position (step S33), and the power generation display process of step S10 ends.

Figure 7:
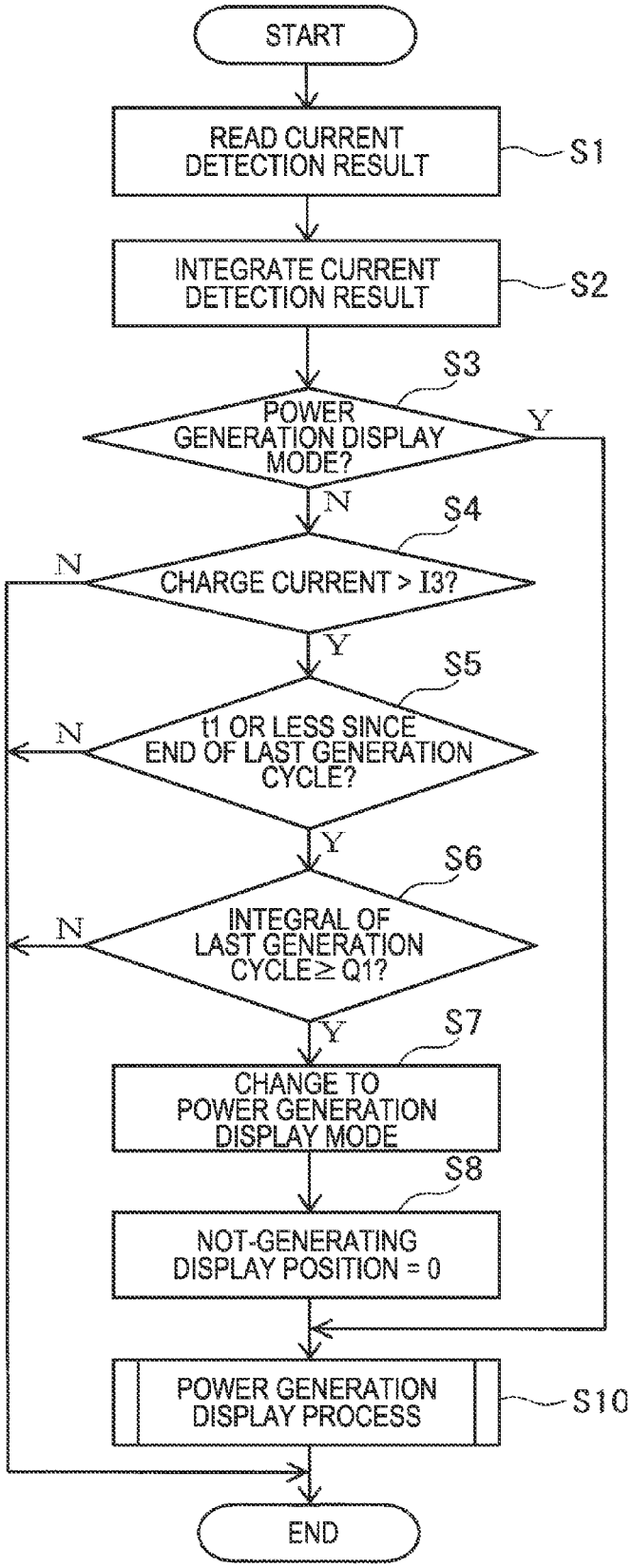
FIG. 7 is a flow chart of the power generation display process in the preferred embodiment of the invention.
Figure 8:
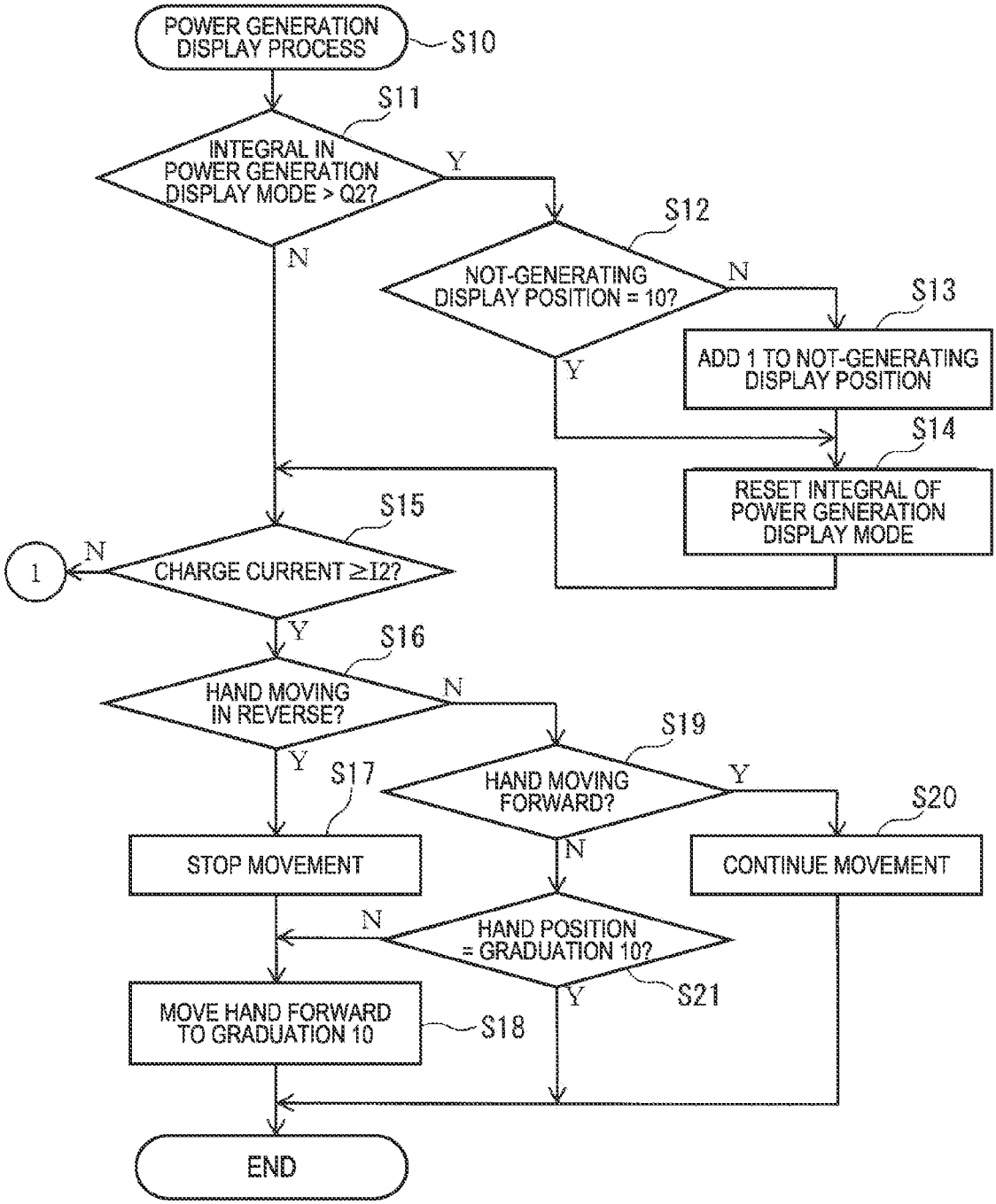
FIG. 8 is a flow chart of the power output display process in FIG. 7.

When the power generation display process of step S10 ends during execution of the steps described above, control returns to the process shown in the flow chart in FIG. 7 and processing at the current sampling time ends.

When the next sampling time comes, control resumes according to the flow chart in FIG. 7, and the power generation display controller 9 repeats the control process described above at each sampling period.

As described above with reference to the accompanying flow charts, the display hand 31 changes from displaying the continuous operating time to displaying power generation when power is generated for a sustained period of time as a result of manually winding the crown 3. In the power generation display mode the power generation display controller 9 moves the display hand 31 according to the generation state, or more specifically according to the charge current level indicated by the detection result signal from the current detector 6, and the user can therefore verify power generation from the movement of the display hand 31.

Figure 10:
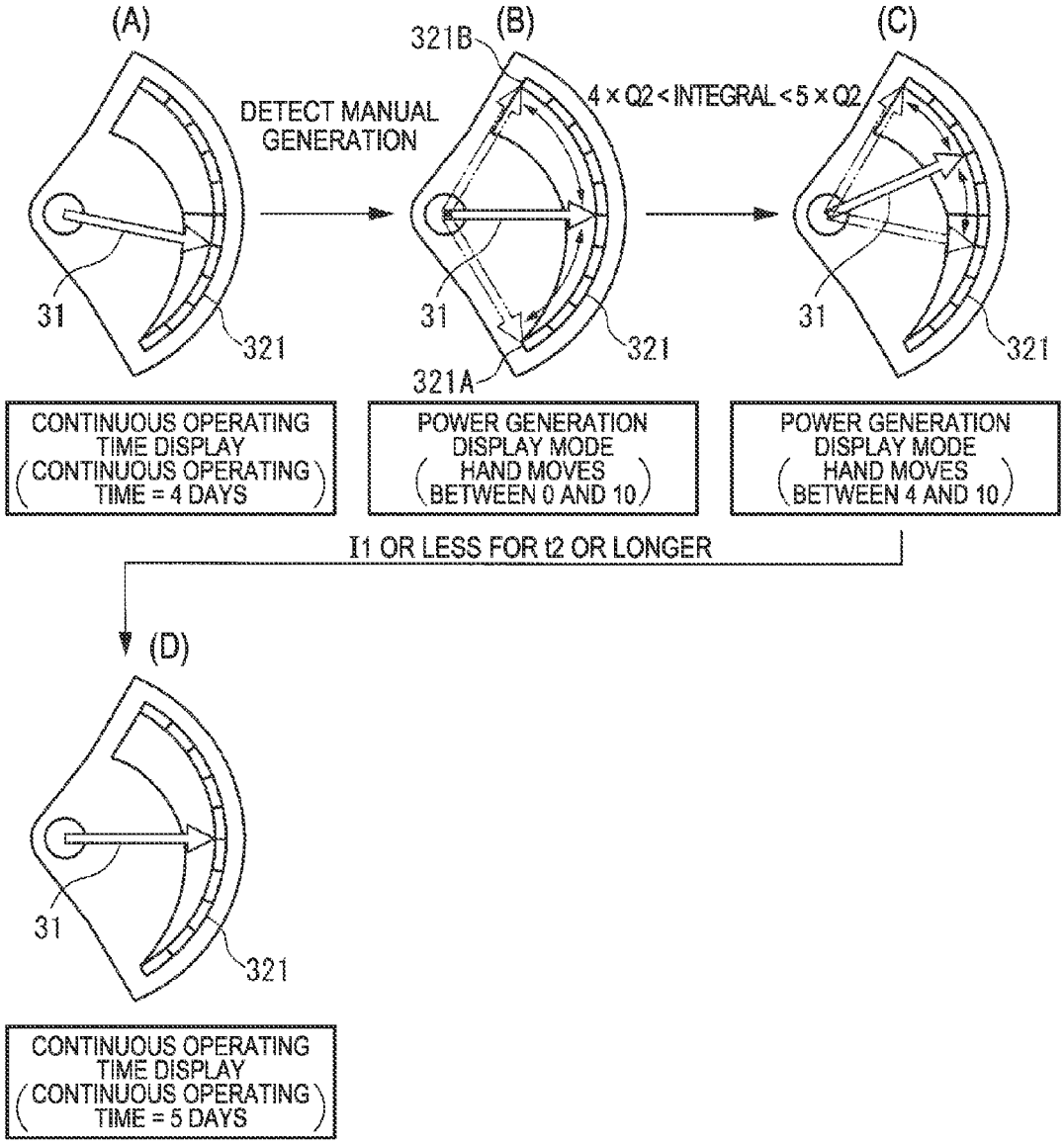
FIG. 10 describes operation of the display hand.

As shown in FIG. 10A, for example, if the display hand 31 is pointing to the fourth graduation (denoting a continuous operating time of four days) and power is then generated by manually winding the crown 3, the power generation display mode is entered as shown in FIG. 10B.

Because the user turns the crown 3 intermittently when generating power manually, times when power is being generated and is not being generated occur alternately as shown in FIG. 6.

When power is being generated, that is, when the charge current is greater than or equal to I2, the power generation display controller 9 moves the display hand 31 forward toward the maximum graduation on the dial (MAX=10), that is, toward the first target position. If the display hand 31 was moving in reverse at this time, the display hand 31 is first stopped and then driven forward.

When power is not being generated, that is, the charge current is less than I2, the power generation display controller 9 moves the display hand 31 in reverse toward the not-generating display position, that is, toward the second target position. If the display hand 31 was moving forward at this time, the display hand 31 is first stopped and then driven in reverse.

By controlling the display hand 31 in this way, movement of the display hand 31 can be made to appear linked to operation of the crown.

Because the display hand 31 is at the not-generating display position (=0) immediately after generation starts, the display hand 31 swings from the zero graduation 321A to the tenth graduation 321B according to the generation state as shown in FIG. 10B.

The not-generating display position is also incremented (moved toward the 10 on the dial) according to the integral of power generation after the power generation display mode is entered. The position to which the display hand 31 returns when power generation is displayed therefore gradually rises along the scale, and the user can visually know how much the battery has been currently charged by manual winding. For example, if the integral of power generation is greater than or equal to (Q2×4) and less than (Q2×5), the not-generating display position is at the fourth graduation, and the display hand 31 therefore swings between the fourth graduation and the tenth graduation as shown in FIG. 10C. As integration of the generated power continues, the not-generating display position is incremented one graduation at a time. When the not-generating display position reaches the tenth graduation, the display hand 31 stops swinging and remains stationary at the tenth graduation. This indicates that the battery has been charged an amount equal to a prescribed continuous operating time, such as one day.

The speed at which the display hand 31 is driven can be the same in both forward and reverse directions. However, the power generation display controller 9 and power generation display motor driver 10 in this embodiment of the invention drive the power generation display motor 11 by applying a 128-Hz drive pulse when moving the display hand 31 forward, and drive the power generation display motor 11 by applying a 64-Hz drive pulse when the display hand 31 moves in reverse. The speed of the display hand 31 when moving forward is therefore twice the speed of the display hand 31 when moving in reverse.

When the user stops winding the crown 3 to manually generate power, or more specifically when the charge current level drops to I1 or below for a predefined time t2 or longer, the continuous operating time display mode is resumed as shown in FIG. 10D. If manual winding has produced a charge equivalent to at least one day, the continuous operating time display is also incremented one graduation.

The invention described above has the following effects.

(1) Because the electronic timepiece 1 has a display hand 31 that moves according to power generation (current generation) detected by the current detector 6, and a power generation display means including a power generation display controller 9 that controls driving the display hand 31, a power generation display motor driver 10, and a power generation display motor 11, the user can confirm power generation by the generating means 4 in real time. The user can therefore confirm if power generation is sufficient during manual power generation, the user can manually operate the power generator while confirming the power generation state, and power can be reliably generated manually.

(2) Both the time and power generation status can be displayed simultaneously because power generation is displayed using a display hand 31 separate from the hands 20 for displaying the time. This improves usability and convenience compared with an arrangement in which the time display hands 20 are also used to display the power generation status.

Furthermore, because power generation can be indicated using the display hand 31, power generation can be displayed visually and in real-time similarly to a tachometer, and the user can visually and easily determine the power generation status.

(3) Because the current detector 6 has a peak detection circuit 62, the need for a capacitor can be eliminated, the hardware configuration can be simplified, and power generation can be detected with no delay.

(4) The power generation display controller 9 can control moving the display hand 31 forward or reverse by simply determining whether the charge current is greater than or equal to I2. The control process is thus simplified and the control algorithm can be simplified.

Tests using working models also demonstrated that even though display control is quite simple the power generation display appears natural and not visually discordant for the user that is manually winding the generator, enabling the user to easily verify the power generation status.

(5) Furthermore, because the power generation display controller 9 stops movement of the display hand 31 based on the previous detection result and moves the display hand 31 in reverse if the result of determining whether the charge current is greater than or equal to I2 differs from the previous result as shown in step S17 and step S32, the display hand 31 can indicate the power generation state more naturally.

(6) Because the power generation display controller 9 integrates power generation after entering the power generation display mode and increments the not-generating display position one graduation each time power generation reaches Q2, the user can substantially simultaneously determine from the same display hand 31 both the instantaneous power generation state and how much power (charge) has been generated since the power generation display mode started, thus improving convenience.

(7) Because the power generation display controller 9 drives the display hand 31 faster when moving forward than when moving in reverse, movement of the display hand 31 appears smooth and the display is visually pleasing to the user.

(8) The power generation display controller 9 normally displays the continuous operating time and switches to the power generation display mode when generating power. Information with a strong mutual correlation can thus be displayed using the same display hand 31, and the electronic timepiece 1 user can get the desired information easily. Furthermore, by using the display hand 31 to display different information, it is not necessary to increase the number of hands or motors, and the arrangement of the electronic timepiece 1 can be simplified.

Furthermore, because the continuous operating time is normally displayed, the user can know approximately how long the electronic timepiece 1 can continue operating without charging, and power can be generated to charge the battery before the timepiece stops. The electronic timepiece 1 can thus be prevented from stopping.

(9) The power generation display controller 9 switches from the continuous operating time display mode to the power generation display mode when all of the conditions tested in steps S4 to S6 are met. As a result, in an electronic timepiece 1 that can generate power in a self-winding mode and a manual winding mode, the power generation display mode is selected when power is generated manually, and switching to the power generation display mode can be prevented when power is generated automatically in the self-winding mode. The power generation state can therefore be reliably displayed for the user when in the manual winding power generation mode and power can be generated efficiently. Furthermore, when the user is unaware that power is being generated, such as when power is generated automatically in the self-winding mode, the hand moves in small increments and power consumption can be reduced compared with using the power generation display mode, which consumes more power than the continuous operating time display mode.

(10) The power generation display controller 9 automatically resets the continuous operating time display mode if the charge current is less than or equal to I1 continuously for time t2 or longer. The user therefore does not need to reset the display mode and usability is thus improved.

The invention is not limited to the embodiment described above, and variations and modifications achieving the same object are included in the scope of the present invention.

Figure 11:
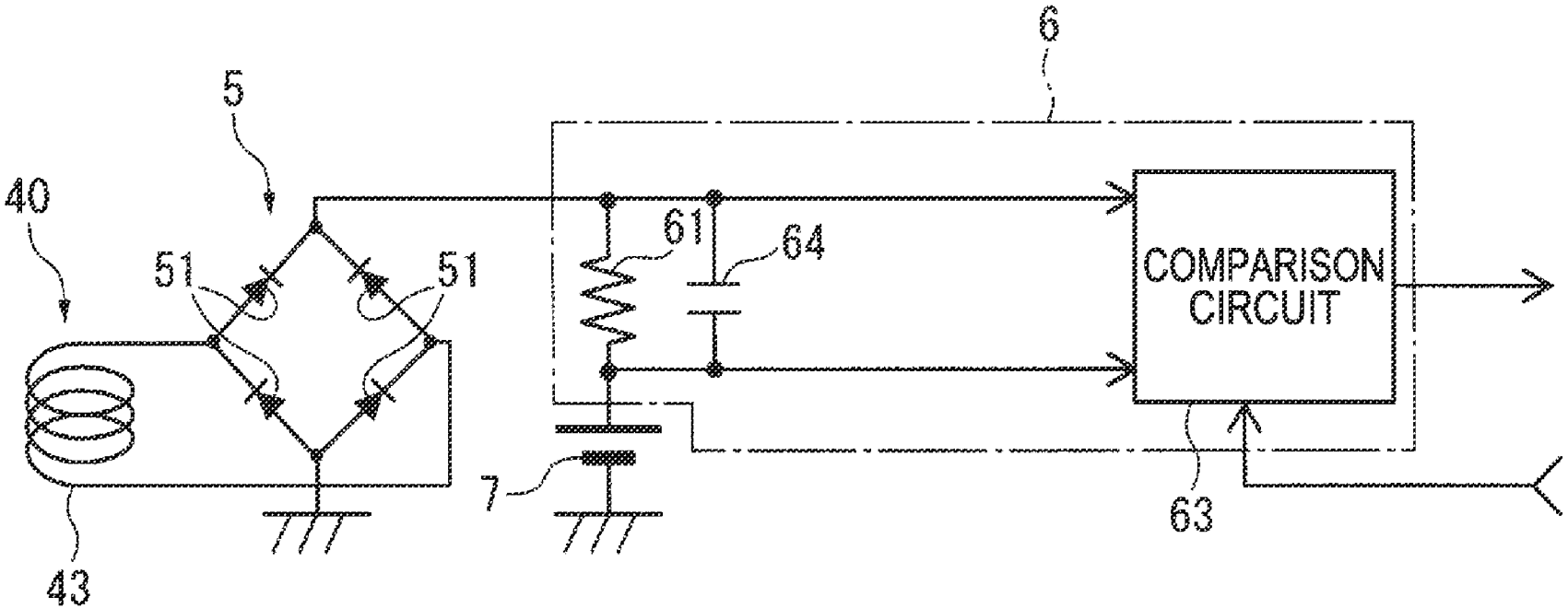
FIG. 11 is a circuit diagram showing of the rectifier means and current detection means in an alternative embodiment of the invention.

As shown in FIG. 11, the current detector 6 can be rendered with a capacitor 64 connected parallel to the resistor 61, and used to detect the average charge current. This arrangement integrates and averages the charge current by means of the capacitor 64, and can therefore detect how much the secondary battery 7 is charged per unit time by means of a simple process.

When the display hand 31 is driven forward in the foregoing embodiment, the display hand 31 is always driven towards the tenth graduation, but the first target position, which is the target when driving the display hand 31 forward, can be varied according to the level of the charge current. For example, the display hand 31 could be moved to approach the eighth graduation if the charge current is greater than or equal to I2 and less than I3, the ninth graduation if the charge current is greater than or equal to I3 and less than I4, and towards the tenth graduation if the charge current is greater than or equal to I4.

This enables reflecting the actual level of the generated current in the movement of the display hand 31, particularly enables moving the display hand 31 quickly, and enables more faithfully displaying the actual generating state if the motor can move the display hand 31 to the target position within each sampling period.

Movement of the display hand 31 is controlled with each sampling result in the foregoing embodiment of the invention, but can be controlled based on the integral or average of a plurality of samples.

If movement is controlled based on a plurality of sampling results, the effect of sudden fluctuations can be suppressed, and stable movement control, or more precisely a stable indication of power generation, can be achieved.

The conditions for changing the indication by the display hand 31 from the continuous operating time display to the power generation display mode are not limited to those described in the foregoing embodiment, and can be set appropriately according to the characteristics of the generator 40.

For example, if a prescribed charge current (such as I4) is detected when in the continuous operating time display mode, the power generation display mode can be immediately enabled. This enables changing the display more quickly than the embodiment described above. The generator 40 can generator power as a result of automatic winding and manual winding in the foregoing embodiment, and these conditions are set based on the characteristics of manually wound power generation in order to detect only manual power generation. If only a self-winding power generator is provided, however, it is not necessary to set the conditions for changing the display mode with consideration for manually wound power generation, and the display mode can be changed by simply detecting if the charge current is greater than or equal to a prescribed threshold value (such as I4).

Operation can also be changed from the continuous operating time display mode to the power generation display mode if a prescribed level of power generation continues for a prescribed time or longer within a set period. For example, the display mode could be changed if a charge current of I2 or greater is detected three or more times within one second, and this detection state continues for five seconds or longer.

These transition conditions are particularly effective when a generator that produces a constant output level for a extended period of time is used, such as a solar generator or generation by means of an external AC field.

Operation can also be changed from the continuous operating time display mode to the power generation display mode if a prescribed charge (such as Q1) is produced by a single generation cycle, and this repeats a prescribed number of times (such as twice) within a prescribed time (such as one second).

These transition conditions enable quickly switching to the power generation display mode when power is produced a specific number of times within a prescribed time, such as with manual winding, and impedes switching to the power generation display mode when power is produced at irregular intervals, such as with a self-winding generator. When both self-winding and manual winding generation are possible, this arrangement impedes switching to the power generation display mode when power is produced in the self-winding mode in which verifying the generation state can be difficult because power is not intentionally generated by the user, and easily enters the power generation display mode only when power is produced as a result of intentional manual winding by the user. Unnecessarily executing the power generation display process can therefore be eliminated, and power consumption by displaying the power generation state can be reduced.

Further alternatively, the power generation display mode can be manually selected by the user manually operating an external operating member, such as by pressing a push-button disposed to the electronic timepiece 1.

If the display mode is thus changed manually, the display mode can be activated and the display can be changed reliably as intended by the user only when the user specifically wants to verify the power generation state, unnecessarily displaying the power generation state can be eliminated, and power consumption can be reduced.

Further alternatively, a switch that detects rotation of the crown 3 can be provided, and operation can be switched to the power generation display mode when this switch detects rotation of the crown 3. Because the display is also changed in this arrangement as a result of the user manually winding the crown 3, the display can be changed reliably in response to a user action, unnecessarily displaying the power generation state can be eliminated, and power consumption can be reduced.

In addition, because the display is changed as a direct result of winding the crown 3 for manual generation when a manual generator that is operated by rotation of the crown 3 is provided, the display mode can be reliably changed, and manual generation can be reliably displayed. More specifically, when the display is changed based on such parameters as the charge current level and time as in the foregoing embodiment, changing the display may not be possible depending on how the user winds the crown 3, and changing the display mode is therefore dependent on how the crown 3 is wound. However, if a switch that detects rotation of the crown 3 is provided, the display can be reliably changed by simply detecting rotation of the crown 3, and changing the display mode is no longer dependent on how the crown 3 is wound.

If power can be produced by both self-winding and manual winding, When both self-winding and manual winding generation are possible, this arrangement impedes switching to the power generation display mode when power is produced in the self-winding mode in which verifying the generation state can be difficult because power is not intentionally generated by the user, and reliably enters the power generation display mode only when power is produced as a result of intentional manual winding by the user. Unnecessarily executing the power generation display process can therefore be eliminated, and power consumption by displaying the power generation state can be reduced.

The condition for returning from the power generation display mode to the continuous operating time display mode in the foregoing embodiment is that the charge current is I2 or less continuously for a prescribed time t2 or longer. Alternatively, the continuous operating time display mode can be resumed when a prescribed time passes from changing the continuous operating time display to the power generation display mode irrespective of charge current detection.

This arrangement simplifies the control circuit configuration because returning to the continuous operating time display is controlled based only on the passage of time. The user can also confirm the generation state when power is generated and the power generation display mode is entered, and can then also easily confirm the continuous operating time because the continuous operating time display is automatically resumed after a prescribed time. More specifically, because the display changes automatically from the power generation display mode to the continuous operating time display, the user can confirm both power generation and the continuous operating time without doing anything after the power generation display mode is enabled, and convenience can thus be improved.

The power generation display means is not limited to a display hand 31 that can move only through a limited angular range, and a display hand 31 disposed to rotate one full revolution (360 degrees) can be used.

However, moving the display hand 31 through a limited angular range as in the foregoing embodiment enables using a larger hand and thereby improves readability when the display hand 31 is disposed as an auxiliary hand in a subdial on the main dial of the timepiece 1.

The generator 40 is also not limited to a manual winding generator or a self-winding generator as described above, and various other types of generators can be used, including a generator that operates using an external AC field, a solar generator, and a thermoelectric generator. In addition, the electronic timepiece 1 could incorporate a single type of generator or plural different types of generator assemblies as in the foregoing embodiment.

The invention is also not limited to use in a wristwatch, and can be used in other types of timepieces having an internal generator, including pocket watches, table clocks, and wall clocks.

More specifically, the invention can be used widely in electronic timepieces that have a generator function and multiple hands including an auxiliary hand that is separate from the hands for indicating the time, and use the auxiliary hand to display the remaining continuous operating time of the timepiece and power generation by the generator.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic timepiece with a generator function, comprising:

a generating means;

a storage means that stores electrical energy produced by the generating means;

a timekeeping control means that is driven by the electrical energy stored in the storage means;

a time display means that is controlled by the timekeeping control means and displays time;

a power generation current detection means that detects current output by the generating means; and a power generation display means that displays the power generation state based on a detection result signal output from the power generation current detection means;

wherein the power generation display means includes a hand, an actuator that drives the hand in both forward and reverse directions, and control means that selects the forward or reverse drive direction and relative movement of the hand in the selected drive direction according to the detection result of the power generation current detection means.

2. The electronic timepiece with a generator function described in claim 1, wherein:

the power generation current detection means samples the current output generated by the generating means at a prescribed sampling rate, and detects the peak output current in each sample.

3. The electronic timepiece with a generator function described in claim 1, wherein:

the power generation current detection means samples the current output generated by the generating means at a prescribed sampling rate, and detects the average output current in each sample.

4. The electronic timepiece with a generator function described in claim 1, wherein:

the power generation display means includes an output level detection unit that determines if the detected output current is greater than or equal to a predefined threshold value based on a detection result signal from the power generation current detection means, and a drive control unit that drives the actuator to move the hand in a direction toward a first target position when the output level detection unit determines that the output current is greater than or equal to the threshold value, and drives the actuator to move the hand in a direction toward a second target position when the output current is less than the threshold value.

5. The electronic timepiece with a generator function described in claim 4, wherein:

a plurality of threshold values are set; and the first target position and the second target position are changed according to the output current level determined by detection and comparison with the threshold values by the power generation current detection means.

6. The electronic timepiece with a generator function described in claim 4, wherein:

at least one of the first target position and the second target position changes according to an integral of the output current detected by the power generation current detection means.

7. The electronic timepiece with a generator function described in claim 4, wherein:

the drive control unit interrupts driving based on the previous determination when the output level detection unit outputs a result that is different from the previous determination, and moves the hand to a new target position based on the current determination.

8. The electronic timepiece with a generator function described in claim 4, wherein:

the drive control unit moves the hand to a display position that is set based on an integral of plural detection result signals or based on an average of plural detection result signals from the power generation current detection means.

9. The electronic timepiece with a generator function described in claim 4, wherein:

the drive control unit changes the speed at which the hand moves according to the direction of movement.

10. The electronic timepiece with a generator function described in claim 1, wherein:

the power generation display means normally uses the hand to display other information, and changes to a power generation display when electrical power is produced by the generating means.

11. The electronic timepiece with a generator function described in claim 1, wherein:

the power generation display means normally uses the hand to display other information, and changes the hand to the power generation display mode when the power generation current detection means detects a prescribed power output level.

12. The electronic timepiece with a generator function described in claim 1, wherein:

the power generation display means normally uses the hand to display other information, and changes the hand the power generation display mode when a state in which generating a prescribed output power within a prescribed time continues for a prescribed time or longer.

13. The electronic timepiece with a generator function described in claim 1, wherein:

the power generation display means normally uses the hand to display other information, and changes the hand to a power generation display mode when generating a prescribed output level in one generation cycle occurs a prescribed number of times within a prescribed period.

14. The electronic timepiece with a generator function described in claim 1, wherein:

the power generation display means normally uses the hand to display other information, and changes the hand to a power generation display mode when a prescribed output level is generated in one generation cycle and generating a prescribed output level is then detected within a prescribed time.

15. The electronic timepiece with a generator function described in claim 1, further comprising:

an external operating member;

wherein the power generation display means normally uses the hand to display other information, and changes the hand to a power generation display mode when a specific operation of the external operating member is detected.

16. The electronic timepiece with a generator function described in claim 1, further comprising:

an external operating member; and a switch that detects operation of the external operating member;

wherein the power generation display means normally uses the hand to display other information, and changes the hand to a power generation display mode when the switch detects operation of the external operating member.

17. The electronic timepiece with a generator function described in claim 10, wherein:

the power generation display means normally uses the hand to display the remaining continuous operating time of the timepiece.

18. The electronic timepiece with a generator function described in claim 10, wherein:

the power generation display means returns to the normal display mode if the generated output power is not at least a prescribed level for a prescribed time or longer when power generation is being displayed.

19. The electronic timepiece with a generator function described in claim 10, wherein:

the power generation display means returns to the normal display mode at a prescribed time after switching to the power generation display mode.

* * * * *